United States Patent [19]

Daane

[11] Patent Number: 4,767,042

[45] Date of Patent: Aug. 30, 1988

[54] PAPER WEB HANDLING APPARATUS HAVING IMPROVED AIR BAR WITH FINE SCALE TURBULENCE GENERATORS

[75] Inventor: Robert A. Daane, Green Bay, Wis.

[73] Assignee: Advance Systems Inc., Oneida, Wis.

[21] Appl. No.: 61,330

[22] Filed: Jun. 11, 1987

[51] Int. Cl.[4] ..... B65H 20/14; F26B 13/20

[52] U.S. Cl. ..... 226/97; 34/156

[58] Field of Search ..... 226/97; 34/156, 160

[56] References Cited

U.S. PATENT DOCUMENTS

| | | | |
|---|---|---|---|
| 3,739,491 | 6/1973 | Creapo et al. | 34/156 |
| 3,873,013 | 3/1975 | Stibbe | 226/97 |
| 3,936,953 | 2/1976 | Chance et al. | 34/156 X |
| 3,964,656 | 6/1976 | Hella | 34/156 X |
| 4,197,971 | 4/1980 | Stibbe | 226/97 |
| 4,201,323 | 5/1980 | Stibbe et al. | 226/97 |
| 4,265,384 | 5/1981 | Daane | 226/97 |

*Primary Examiner*—Stanley N. Gilreath
*Assistant Examiner*—Lynn M. Sohacki
*Attorney, Agent, or Firm*—James E. Nilles

[57] ABSTRACT

An air bar for apparatus for drying a running paper web and floatingly suspending it without contact during the drying process, which air bars are spaced along both the upper and lower surface of the web. The air bars provided by the present invention have small holes in the inclined walls which form part of the nozzle slots. These holes provide fine scale turbulence generators for air passing through the holes to the slot nozzles.

3 Claims, 3 Drawing Sheets

PAPER WEB HANDLING APPARATUS HAVING IMPROVED AIR BAR WITH FINE SCALE TURBULENCE GENERATORS

BACKGROUND OF THE INVENTION

1. Field of the Invention

The invention relates to air bars for floatingly guiding and suspending an advancing paper web of indeterminate length through an elongated dryer.

2. Background Information

This invention pertains to paper web handling equipment having air bars for floatingly suspending a web and drying the material such as ink or coating on the web, while not permitting the web to touch any supporting surfaces as the web moves rapidly through the elongated dryer.

This invention is in the nature of an improvement over the paper web handling air bars shown in the following U.S. Pat. Nos.: Hella—3,964,656, issued June 22, 1976; Stibbe—No. 4,201,323, issued May 6, 1980; Creapo—No. 3,739,491, issued June 19, 1973; Stibbe—No. 4,197,971, of May 15, 1980; and Stibbe—No. 3,873,013, issued Mar. 25, 1975.

SUMMARY OF THE INVENTION

The present invention provides an air bar for apparatus for drying a running paper web and floatingly suspending it without contact during the drying process. These air tars are spaced along both the upper and lower surface of the web. The air bars provided by the present invention have small holes in the inclined walls forming part of the nozzle slots and which provide fine scale turbulence generators for air passing through the holes to the slot nozzles.

These and other objects and advantages will appear hereinafter as this disclosure progresses, reference being had to the accompanying drawings.

DESCRIPTION OF A PREFERRED EMBODIMENT

Figure 1:
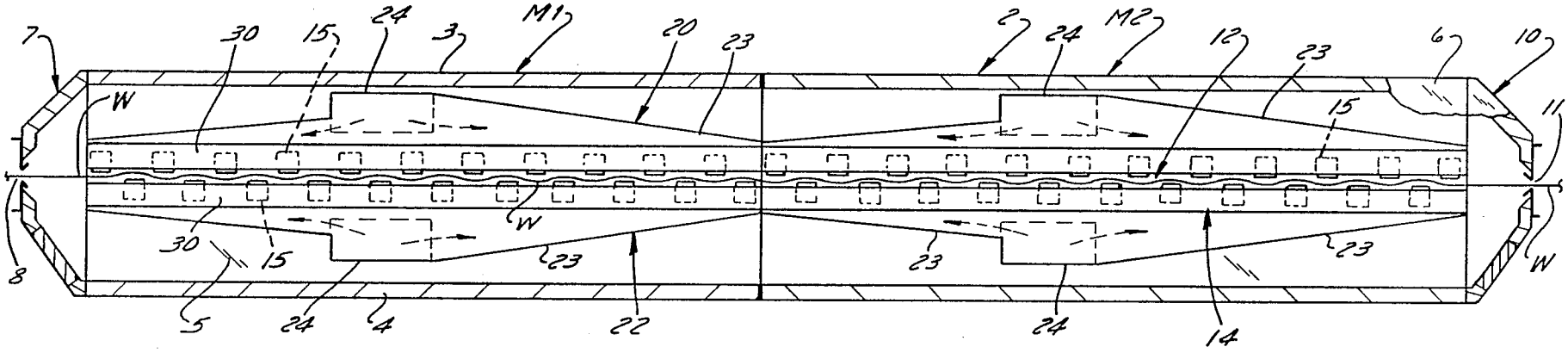
FIG. 1 is a vertical cross-sectional view taken along the length of a web drying apparatus embodying the present invention, the view being generally schematic in nature.

Web drying apparatus for floatingly suspending a running web is shown in FIG. 1 and includes an elongated dryer housing 2 which is enclosed by its insulated top 3, insulated bottom 4, one insulated side 5 and an opposite insulated side 6. An insulated inlet end 7 has a horizontal slot 8 through which the web W enters. The opposite, exit end is formed by the insulated end wall 10 and a corresponding slot 11 therein through which the web exits.

The arrangement includes an upper air bar assembly 12 and a lower air bar assembly 14 between which the web W passes. Assemblies 12 and 14 each have a series of air bars 15 located in spaced apart relationship along each of the upper ard lower sides of the web and these bars are transversely positioned across the web. It will be noted that the upper air bars are in staggered, spaced relationship along the web with respect to the lower air bars to thereby cause the web to assume a conventional sine wave form when in operation, as shown.

Figure 2:
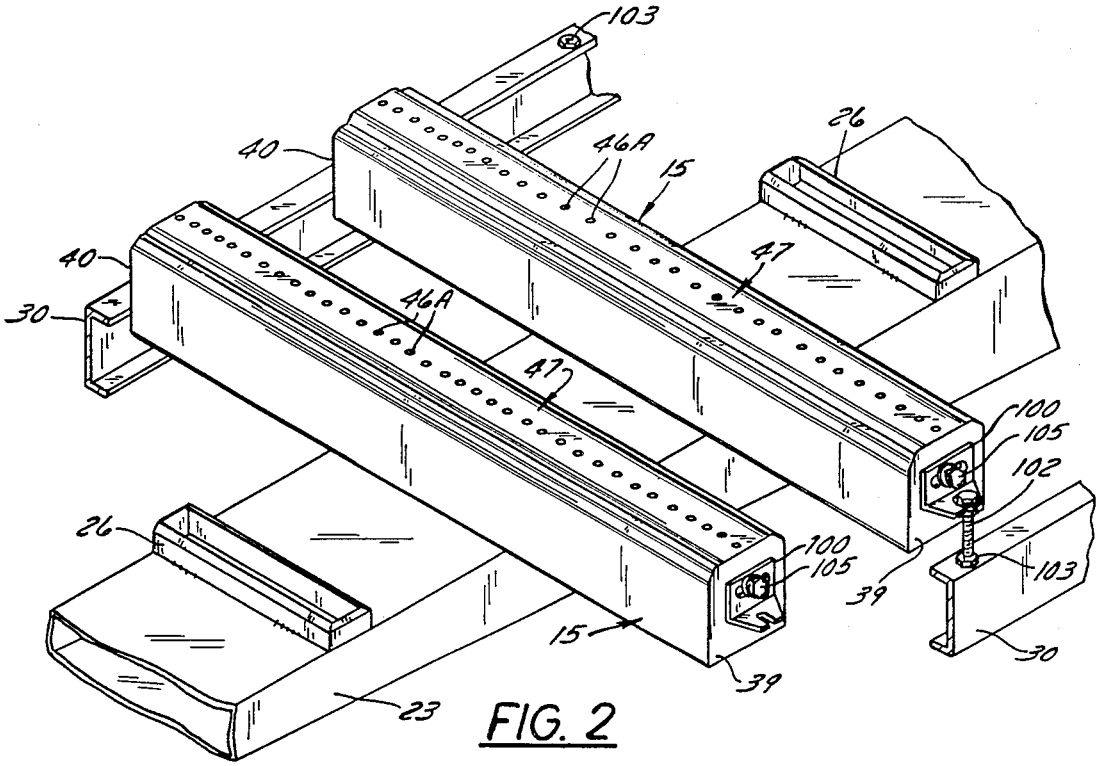
FIG. 2 is a fragmentary, enlarged view of a portion of the apparatus shown in FIG. 1, certain parts being removed for the sake of clarity in the drawings, and showing a pair of air bars as they are mounted on the lower duct means.

An air supply duct means 20 is provided for each module of the upper air bars 15 while a similar air supply duct means 22 is provided for the lower set of air bars 15. These duct means include the longitudinally extending ducts 23 that extend from the central supply duct 24. The ducts 23 each have a series of air feed necks 26 (FIGS. 2 and 3) extending transversely thereacross and at spaced locations along their length. An air bar 15 is in air receiving communication with each of the necks 26 and thus the air supply ducts furnish pressurized air to each of the air bars for ultimate discharge against the web to floatingly support the latter.

The air supply duct means includes the header frame 30 which is mounted within the housing and acts to support the air supply system.

Figure 3:
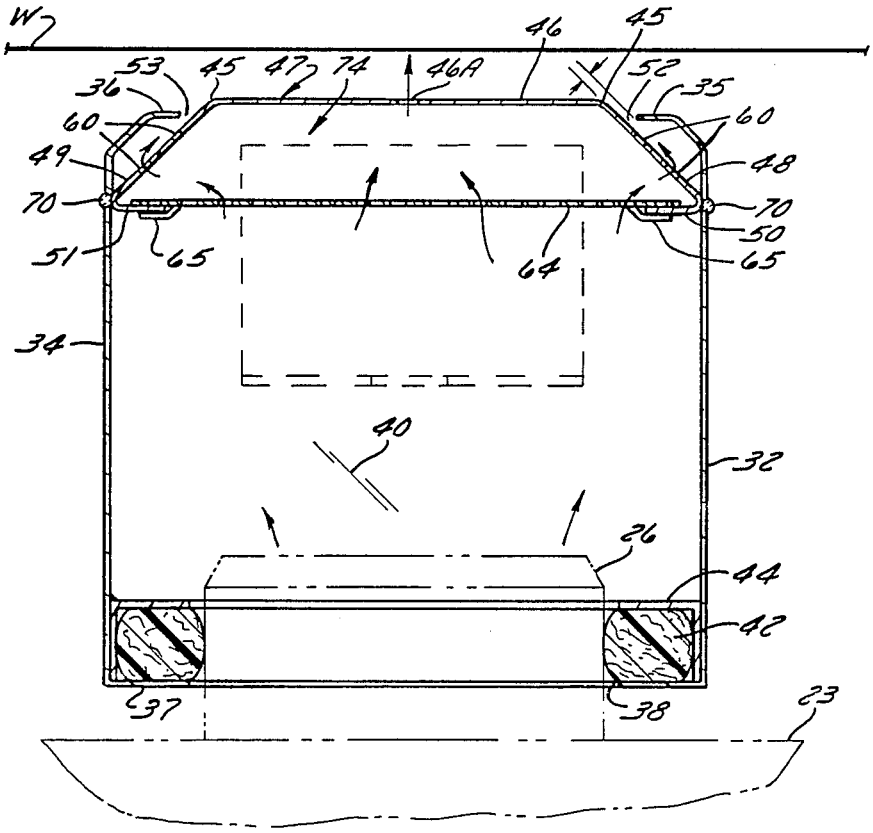
FIG. 3 is a transverse cross-sectional view through one of the air bars shown in FIGS. 1 and 2, but on an enlarged scale.

The air bar shown in detail in FIG. 3 includes the side walls 32, 34 which terminate at their upper ends in the inwardly turned flanges 35, 36, respectively.

The air bars also have end walls 39 and 40 which are welded at the ends of the bars. Adjustment means (FIGS. 2 and 4) are provided on each end of the air bars for adjustably positioning the individual air bars both toward and away from the web and also angularly with respect to the web. This means includes bracket 100, jacking bolt 102, nut 103, and bolt 105.

Figure 4:
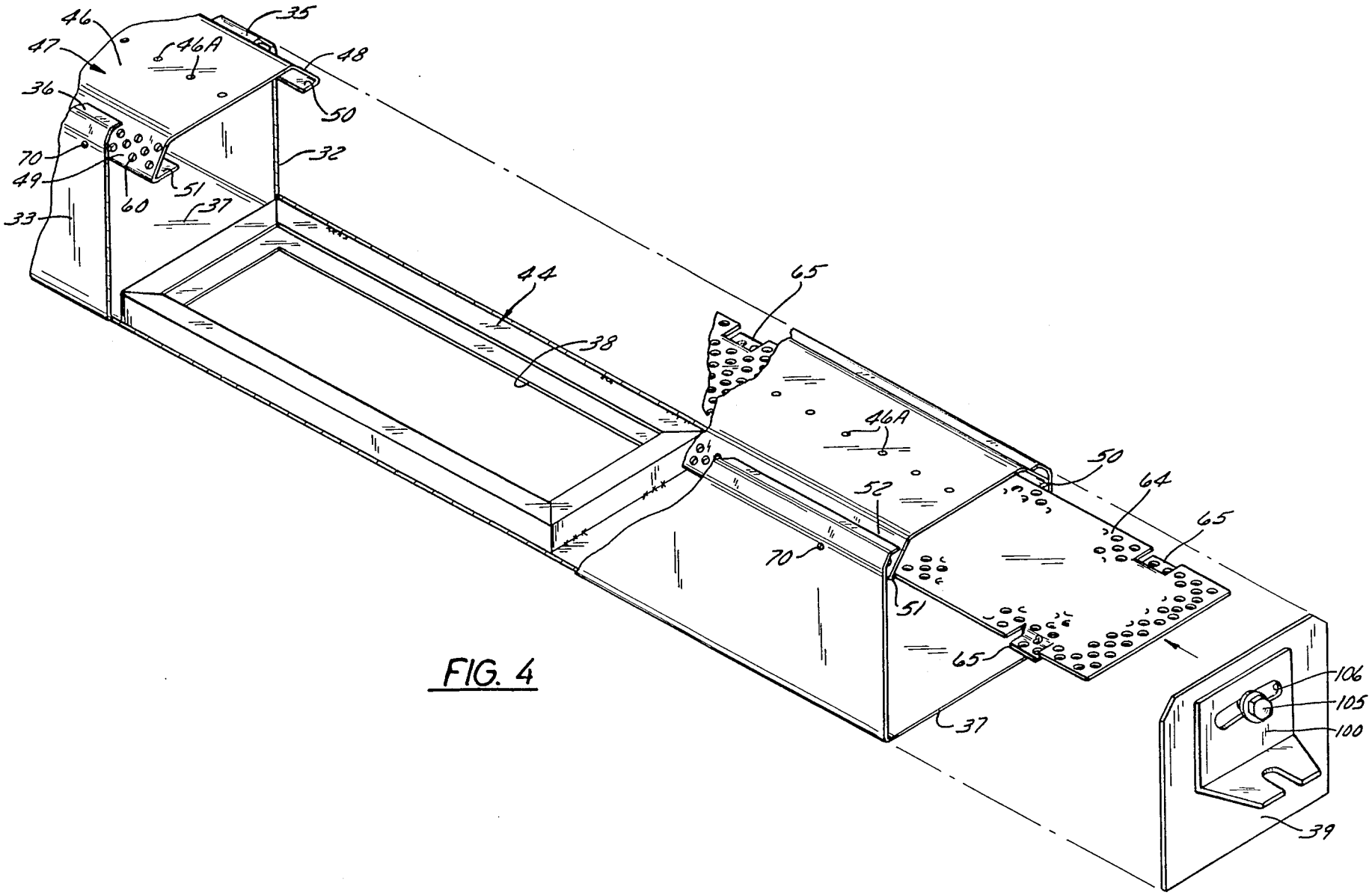
FIG. 4 is a perspective, exploded, fragmentary view of a portion of the air bar shown in the other figures.

The air bars also have a lower wall 37 formed between the side walls and in which a rectangular opening 38 is formed for the purpose of receiving the air feed neck 26 of the duct means. It will be noted that an O-ring type seal 42 is provided in the U-shaped (in cross section) gasket retainer 44 of rectangular form (FIG. 4).

The air bar also includes an upper wall 46 (referred to as the air bar face) which is located adjacent the web. This wall 46 may have a center row of air discharge holes 46A for furnishing additional air to the web, if needed. Without center hole impingement, the region of an air bar between the slots 52 and 53 is rather quiet and heat transfer is very small in that region. Adding air impingement in this region adds directly to heat transfer without interfering with or detracting from the heat transfer effectiveness of the air turbulence already there.

The wall or bar face 46 is part of the air distributing member 47 which also includes the inclined walls 48 and 49 and the inner, inwardly turned flanges or lips 50 and 51. The angle at the juncture 45 of walls 46 and inclined walls 48 and 49 is made having as sharp a break in the sheet metal as possible, so as to preclude a Coanda effect of the discharging air. In other words, this prevents the Coanda effect of the air streams trying to follow the sheet metal surfaces around the breaks. This results in stability of the air flow pattern and a more consistent impingement of sharper slot jets onto the web with maintenance of higher heat transfer regardless of web clearance (within limits). The inclined walls 48 and 49 are inclined at about an angle of 45° to the web, that is, to the inner wall 46, as will presently be more fully explained.

The inclined walls 48 and 49 together with the inwardly turned flanges 35 and 36, respectively, form the nozzle slots 52 and 53, respectively. These slots are preferably of a width of 0.085 to 0.090 after gapping.

It will be noted that flanges 35 and 36 lie slightly below the wall 46 in respect to the web, on the order of 0.125 plus or minus 0.015 inches.

In accordance with the present invention, the inclined walls 48 and 49 each have a series of small holes 60, as contrasted with conventional openings, disposed along their length to thereby provide a fine scale air turbulence generator. This results in a high heat transfer coefficient. This also results in less large scale turbulence and, therefore, less web flutter.

A perforated plate 64 has a series of depressed tabs 65 (FIGS. 3 and 4) pressed therefrom and spaced along the length of plate 64 so that the perforated plate is slidably engageable along the inwardly turned flanges 50 and 51. The member 47 is rigidly secured within the air bar by means of welding plugs 70 along each of its sides and by means of which it is securely fastened to the side walls 32 and 34 of the air bar. Thus, the tabs 65 and flanges 50 and 51 form guide means for slidably supporting the perforated plate 64. The bifurcations formed by the tabs 65 on the perforated plate provide an easily manufactured and readily assembled perforated distribution plate.

In operation pressurized air is introduced from the duct supply means into the interior of the air bar via the neck 26 of the ducts and then the air flows through the perforated plate 64 which causes it to be evenly distributed within the equalizing chamber 74 of the air bar and without appreciable cross currents. Then the pressurized air passes through the small apertures 60 of the inclined portions and through the discharge lot nozzles 52 and 53 against the web, at an angle of about 45°.

In air impingement heat transfer, turbulence in the impinging jet increases the heat transfer coefficient. Turbulance is generated in the jet as it travels from the issuing nozzle to the impinged surface by the mixing action with the surrounding air. Turbulence may also be generated in the air jet upstream of the nozzle.

If the length of travel of the jet between the nozzle and the impinged surface is more than about 8 nozzle slot widths, then the mixing induced turbulence predominates and the turbulence that may be generated by small holes 60 upstream of the nozzle has little effect on heat transfer. However, in the use of the air bars of the present invention, this length of travel is typically only about 4 slot widths. In that case, the heat transfer coefficient can be increased by as much as thirty percent (30%) by turbulence generated upstream of the nozzle.

If the induced turbulence is small in scale, another important advantage is realized. That is that the air impinging on a flexible, light weight web will not disturb it as much as when the jet has large scale turbulence. The air floated web support is quieter and more stable.

In the present invention, the small scale turbulence is induced by passing the jet air stream through small holes upstream of the slot nozzle. Not only are the holes to be small, but also they are spaced closely together so that the land areas or ligaments between the holes are very small.

In a preferred embodiment of this invention, the total area of holes is approximatley 2.5 times that of the slot nozzle so that the air passes through the holes with appreciable velocity but with not such a high velocity that the pressure loss of the air stream is excessive.

Typically, the sheet metal from which these air bars are made will be of 18 guage steel. Considering the desire for small holes and ligaments and at the same time the ability to punch such holes in the sheet metal without high manufacturing cost, we find 0.14 inch diameter holes spaced 0.21 inches apart in an equilateral triangle array to be a good compromise.

What is claimed as the invention is:

1. An elongated, individually replaceable, hollow air bar having an interior for receiving pressurized air, said bar being for use with web drying apparatus for floatingly suspending a running web while the latter is being dried, said air bar having a pair of slot nozzles extending along its length with one nozzle adjacent each side thereof, and through which nozzles pressurized air can be directed from the inside of said bar and against a web for drying and floating of the latter, an air distributing member defining an air distributing chamber within said bar and having an outer wall located between said slot nozzles and spaced outwardly therefrom and defining an air bar face between said nozzles to provide an air pressure supporting surface for a web passing thereover, said distributing member also having a pair of opposed and inclined side walls which in part define said chamber, one side wall adjacent each of said slot nozzles, said inclined side walls having a plurality of small holes therethrough and along their length to provide fine scale air turbulence for air passing through said holes to said slot nozzles that produces a high heat transfer coefficient and reduced web flutter.

2. An elongated, individually replaceable, hollow air bar having an interior for receiving pressurized air, said bar being for use with web drying apparatus for floatingly suspending a running web while the latter is being dried, said air bar having a pair of slot nozzles extending along its length and one nozzle adjacent each side thereof, and through which nozzles pressurized air can be directed from the inside of said bar and against a web for drying and floating of the latter, an air distributing member defining an air distributing chamber within said bar and having an outer wall located between said slot nozzles and spaced outwardly therefrom and defining an air bar face between said nozzles to provide an air pressure supporting surface for a web passing thereover, said distributing member also having a pair of opposed and inclined side walls which in part define said chamber, one side wall adjacent each of said slot nozzles, said inclined side walls having a plurality of small holes therethrough and along their length to provide fine scale air turbulence for air passing through said holes to said slot nozzles that produces a high heat transfer coefficient and reduced web flutter, said small holes being about 0.14 inches in diameter, and said small holes defining about 2.5 times the area of the slot nozzles which they feed, said small holes being spaced apart such that the ligaments between them are about 0.07 inches wide at their narrowest point.

3. The air bar as set forth in claim 2 including a perforated plate spaced inwardly from said outer wall, said perforated plate also in part defining said chamber and through which pressurized air passes from the interior of said bar, through said small holes and then through said slot nozzles.

* * * * *